US011994142B2

(12) United States Patent
Tomioka et al.

(10) Patent No.: US 11,994,142 B2
(45) Date of Patent: May 28, 2024

(54) BLOWER

(71) Applicant: DAIKIN INDUSTRIES, LTD., Osaka (JP)

(72) Inventors: Hirotaka Tomioka, Osaka (JP); Yuuki Kirikuri, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/714,145

(22) Filed: Apr. 6, 2022

(65) Prior Publication Data

US 2022/0228598 A1 Jul. 21, 2022

Related U.S. Application Data

(63) Continuation of application No. PCT/JP2019/040969, filed on Oct. 17, 2019.

(51) Int. Cl.
*F04D 29/054* (2006.01)
*F04D 19/00* (2006.01)

(52) U.S. Cl.
CPC ..... *F04D 29/054* (2013.01); *F04D 19/002* (2013.01)

(58) Field of Classification Search
CPC .... F04D 29/263; F04D 29/281; F04D 29/054; F04D 19/002
See application file for complete search history.

(56) References Cited

U.S. PATENT DOCUMENTS 7,165,939 B2 * 1/2007 Chen ..... F04D 29/263 415/216.1
11,111,929 B2 * 9/2021 Taki ..... F04D 29/263

FOREIGN PATENT DOCUMENTS

| | | | |
|---|---|---|---|
| JP | S55-149597 | U | 10/1980 |
| JP | S59-45295 | U | 3/1984 |
| JP | H107-004396 | A | 1/1995 |
| JP | H10-318189 | A | 12/1998 |
| JP | 2001-124101 | A | 5/2001 |
| JP | 2007-285237 | A | 11/2007 |
| JP | 2019-190349 | A | 10/2019 |
| KR | 100745584 | B1 | 8/2007 |

OTHER PUBLICATIONS

International Preliminary Report on Patentability issued in corresponding International Application No. PCT/JP2019/040969 mailed Apr. 28, 2022 (6 pages).

(Continued)

*Primary Examiner* — J. Todd Newton
*Assistant Examiner* — Jackson N Gillenwaters
(74) *Attorney, Agent, or Firm* — Osha Bergman Watanabe & Burton LLP

(57) ABSTRACT

A fan includes: a shaft including an outer peripheral surface that includes a first circular-arc portion, and a first flat portion; and a boss portion including a fitting hole with an inner peripheral surface that includes a second circular-arc portion, and a second flat portion. The second circular-arc portion corresponds to the first circular-arc portion. The second flat portion corresponds to the first flat portion. One or both of the first flat portion and the second flat portion includes a notch in an end portion in a width direction of the one or both of the first flat portion and the second flat portion.

6 Claims, 5 Drawing Sheets

(56) References Cited

OTHER PUBLICATIONS

Extended European Search Report issued in corresponding European Patent Application No. EP 19949503.7 dated Sep. 6, 2022 (7 pages).
International Search Report issued in corresponding International Application No. PCT/JP2019/040969 mailed Nov. 12, 2019 (3 pages).
Written Opinion issued in corresponding International Application No. PCT/JP2019/040969 mailed Nov. 12, 2019. (3 pages).

* cited by examiner

BLOWER

TECHNICAL FIELD

The present disclosure relates to a fan.

BACKGROUND

A fan of Patent Document 1 includes a shaft having a D-shaped cross section, and a boss portion having a hole (fitting hole) into which the shaft is fitted. The shaft rotated by a motor has its rotational power transmitted to the boss portion. This allows a plurality of blades to rotate.

PATENT LITERATURE

Patent Document 1: Japanese Unexamined Patent Publication No. 2001-124101

SUMMARY

A fan according to one or more embodiments of the present disclosure includes: a shaft (20) having an outer peripheral surface (21) that includes a first circular-arc portion (22) and a first flat portion (23); and a boss portion (40) having a fitting hole (41) with an inner peripheral surface (42) that includes a second circular-arc portion (43) and a second flat portion (44). The second circular-arc portion (43) corresponds to the first circular-arc portion (22). The second flat portion (44) corresponds to the first flat portion (23). At least one of the first flat portion (23) or the second flat portion (44) has at least one end portion (23*a*, 23*b*, 44*a*, 44*b*) with a notch (51, 52, 53, 54) in a width direction of the at least one of the flat portions (23, 44).

DETAILED DESCRIPTION

Embodiments

A fan (10) of one or more embodiments will be described below with reference to the drawings.

<General Configuration>

Figure 1:
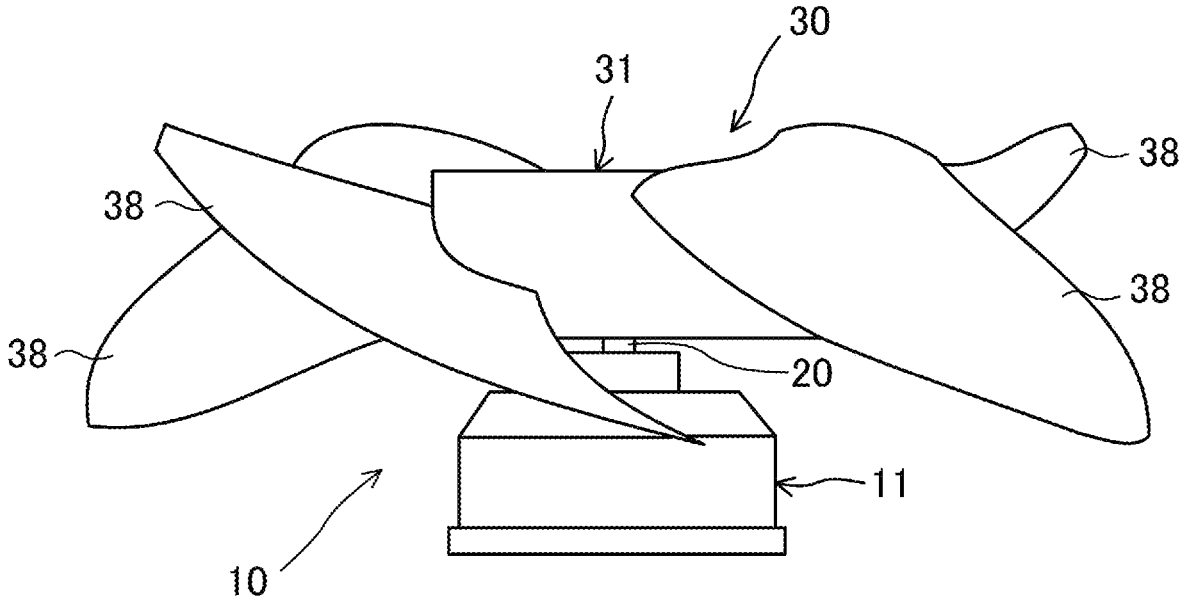
FIG. 1 is a front view illustrating a schematic configuration of a fan according to one or more embodiments.

The fan (10) is used for an outdoor unit of an air conditioner, for example. The fan (10) constitutes a propeller fan that is an axial fan. As illustrated in FIG. 1, the fan (10) includes an electric motor (11), a shaft (20) rotated by the electric motor (11), and an impeller (30) coupled to the shaft (20). The shaft (20) is made of a metal material. The impeller (30) is made of a resin material that is less rigid than the shaft (20) is. The impeller (30) includes a substantially cylindrical hub (31), and a plurality of blades (38) supported on an outer peripheral surface of the hub (31).

Figure 2:
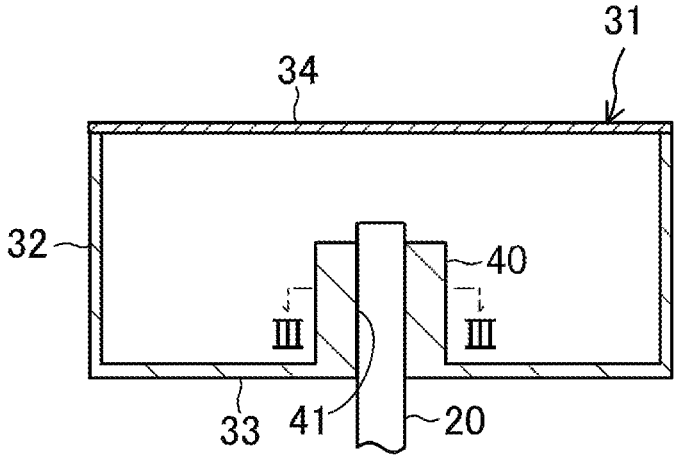
FIG. 2 is a vertical sectional view illustrating a schematic configuration of a hub according to one or more embodiments.

As illustrated in FIG. 2, the hub (31) includes an outer cylinder (32), a bottom plate (33), a lid (34), and a boss portion (40). The outer cylinder (32) is formed in the shape of a hollow cylinder. The bottom plate (33) closes one of openings of the outer cylinder (32) near one axial end thereof (near the electric motor (11)). The lid (34) closes the other opening of the outer cylinder (32) near the other axial end thereof (in a direction remote from the electric motor (11)). The boss portion (40) protrudes axially inward from a central portion of the inner wall of the bottom plate (33).

<Detailed Structures of Shaft and Boss Portion>

Figure 3:
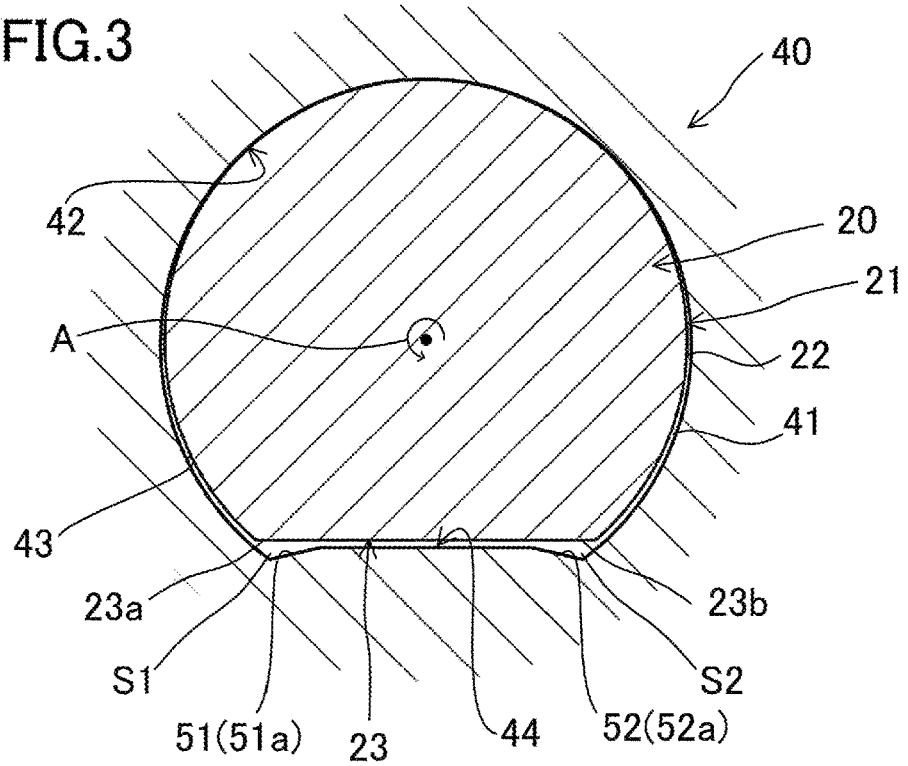
FIG. 3 is a cross-sectional view taken along line III-III shown in FIG. 2.
Figure 4:
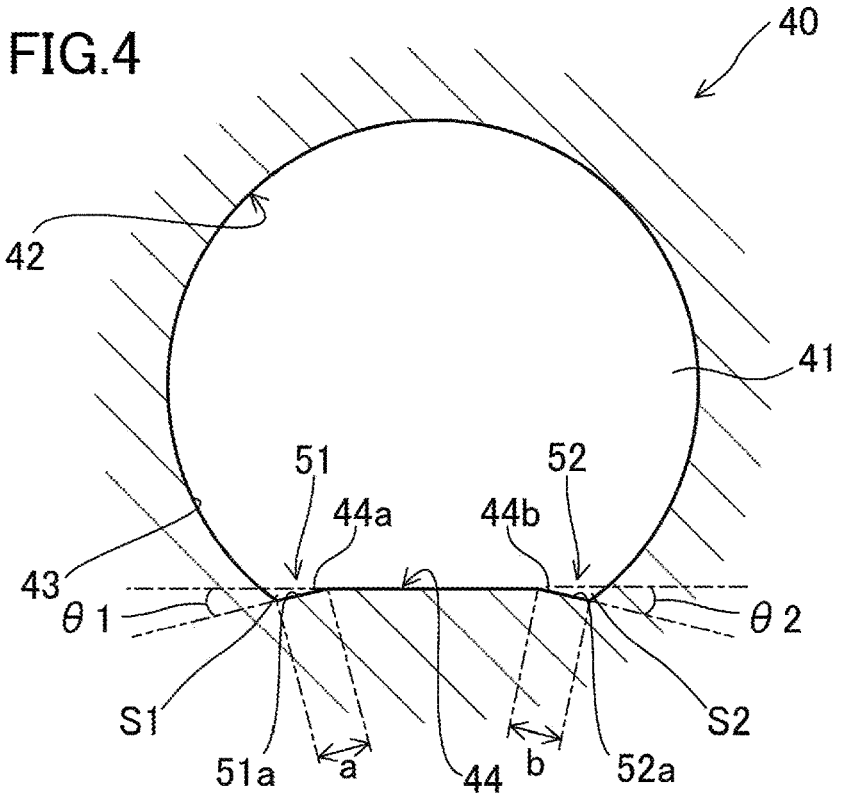
FIG. 4 is a diagram corresponding to FIG. 3 from which a shaft is omitted.

The shaft (20) and the boss portion (40) will be described in detail below with reference to FIGS. 3 to 5. In these drawings, the size of each of notches, the angle of inclination, width, and other elements of each of the notch surfaces are exaggerated. The notches will be described in detail below.

The shaft (20) of one or more embodiments has a substantially D-shaped, outer peripheral surface (21) as viewed in cross section perpendicular to the axis of the shaft (20). Specifically, the outer peripheral surface (21) of the shaft (20) has one first circular-arc portion (22) and one first flat portion (23).

The boss portion (40) has a fitting hole (41) into which the shaft (20) is fitted. The fitting hole (41) of one or more embodiments has a substantially D-shaped, inner peripheral surface (42) as viewed in cross section perpendicular to the axis of the fitting hole (41). Specifically, the inner peripheral surface (42) of the fitting hole (41) has a shape corresponding to that of the outer peripheral surface (21) of the shaft (20). The inner peripheral surface (42) of the fitting hole (41) of the boss portion (40) has one second circular-arc portion (43) corresponding to the first circular-arc portion (22), and one second flat portion (44) corresponding to the first flat portion (23). A gap is formed between the inner peripheral surface (42) of the fitting hole (41) and the outer peripheral surface (21) of the shaft (20). The gap results from the fit tolerance.

In one or more embodiments, the flat portion (second flat portion (44)) of the boss portion (40) has notches (51, 52). In one or more embodiments, both end portions of the second flat portion (44) in the width direction thereof (the lateral direction in FIG. 3) have the notches (51, 52), respectively. Specifically, one of the end portions of the second flat portion (44) in the width direction located backward in the direction of rotation of the shaft (20) (the direction indicated by the arrow A in FIG. 3) (a first end portion (44*a*)) has a first notch (51). The other end portion of the second flat portion (44) in the width direction located forward in the direction of rotation of the shaft (20) (a second end portion (44*b*)) has a second notch (52).

The first notch (51) has a flat first notch surface (51*a*). As illustrated in FIG. 4, the first notch surface (51*a*) forms a predetermined angle θ1 with respect to the second flat portion (44). The width a of the first notch surface (51*a*) is less than the width of the second flat portion (44). The first notch surface (51*a*) constitutes a pressure receiving surface with which the first flat portion (23) of the shaft (20) rotating forward comes into surface contact.

The second notch (52) of one or more embodiments is configured to be a mirror image of the first notch (51) with respect to the second flat portion (44). That is to say, the second notch (52) has a flat second notch surface (52*a*). In one or more embodiments, the angle θ2 of the second notch surface (52*a*) with respect to the second flat portion (44) is equal to the angle θ1. In one or more embodiments, the width b of the second notch surface (52*a*) is equal to the width a of the first notch surface (51*a*). The angle θ2 and width b of the second notch surface (52*a*) may be respectively different from the angle θ1 and width a of the first notch surface (51*a*). The second notch surface (52*a*) constitutes a pressure receiving surface with which the second flat portion (44) of the shaft (20) rotating in the reverse direction comes into surface contact.

A first space (S1) is formed between the first flat portion (23) of the shaft (20) and the first notch (51) of the boss portion (40). The first space (S1) can be said to be a space entered by one end portion (23*a*), in the width direction, of the first flat portion (23) of the shaft (20) rotating forward during operation of the fan (10). A second space (S2) is formed between the first flat portion (23) of the shaft (20) and the second notch (52) of the boss portion (40). The second space (S2) can be said to be a space entered by the other end portion (23*b*), in the width direction, of the first flat portion (23) of the shaft (20) rotating in the reverse direction under the influence of wind or other elements.

—Action of Notches—

The first notch (51) functions to substantially prevent the long-term use of the fan (10) from causing plastic deformation of the inner peripheral surface (42) of the fitting hole (41) of the boss portion (40). This will be described in detail.

During operation of the fan (10), the electric motor (11) rotates the shaft (20). During this rotation, the first flat portion (23) of the shaft (20) and the second flat portion (44) of the boss portion (40) come into surface contact with each other. This allows the impeller (30) to rotate.

According to the known configuration, the second flat portion (44) has no notch. For this reason, if the first flat portion (23) of the shaft (20) is slightly inclined with respect to the second flat portion (44) under the influence of the gap resulting from the fit tolerance between the shaft (20) and the fitting hole (41), one of end portions of the first flat portion (23) is in local contact with an associated one of end portions of the second flat portion (44). As a result, stress concentrates on the associated end portion of the second flat portion (44), resulting in plastic deformation of the associated end portion. This may cause a plastically deformed portion of the inner peripheral surface (42) of the fitting hole (41) to mesh with the shaft (20), resulting in difficulty in detaching the shaft (20) from the fitting hole (41). In this case, the impeller (30) is unable to be easily detached from the shaft (20). This complicates the work of replacement of the impeller (30) and maintenance work.

In one or more embodiments, the first end portion (44*a*) of the second flat portion (44) has the first notch (51). As illustrated in FIG. 5, if the first flat portion (23) of the shaft (20) rotating forward is slightly inclined with respect to the second flat portion (44) of the fitting hole (41) under the influence of the gap, the one end portion (23*a*) of the first flat portion (23) enters the first space (S1). This can substantially prevent the one end portion (23*a*) of the first flat portion (23) from coming into strong contact with the first end portion (44*a*) of the second flat portion (44), and can reduce the plastic deformation of the inner peripheral surface (42) of the fitting hole (41).

Figure 5:
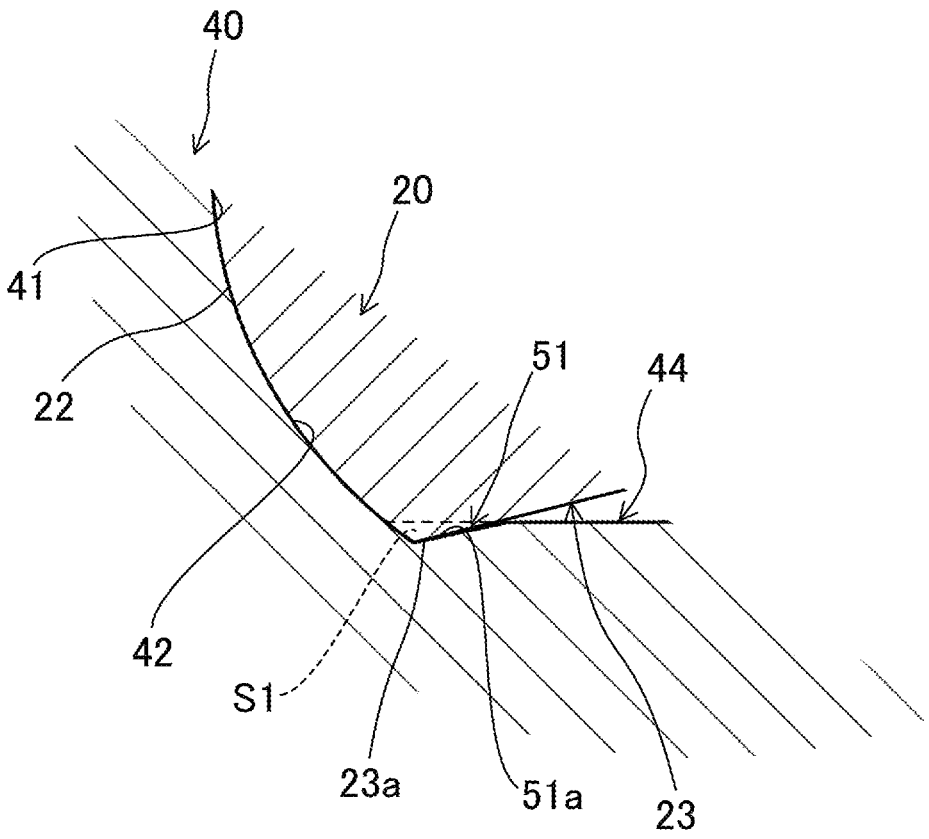
FIG. 5 is an enlarged view corresponding to FIG. 3 and illustrating how a notch and the shaft are in surface contact with each other.

As illustrated in FIG. 5, if the first flat portion (23) is slightly inclined with respect to the second flat portion (44), the first flat portion (23) is in surface contact with the first notch surface (51*a*) of the first notch (51). In other words, the first notch surface (51*a*) can form a sufficiently large pressure receiving surface that receives the torque of the shaft (20). This can avoid stress concentration on the first notch (51). As a result, the plastic deformation of the inner peripheral surface (42) of the fitting hole (41) can be reduced.

The width a and the angle θ1 of inclination of the first notch surface (51*a*) of the first notch (51) are set such that the first flat portion (23) and the first notch surface (51*a*) can be reliably in surface contact with each other, and such that plastic deformation of the first notch (51) can be reliably reduced. Specifically, first, the optimum width a of the first notch surface (51*a*) is determined with consideration given to the size of the gap resulting from the fit tolerance between the shaft (20) and the fitting hole (41), a load acting on the boss portion (40) during rotation of the shaft (20), the strength of the boss portion (40) during this rotation, the axial length of a portion of the shaft (20) fitted into the boss portion (40), and other elements. Next, the optimum angle θ1 of inclination of the first notch (51) is set to be an angle that would allow the first notch surface (51*a*) to substantially match the trajectory of the first flat portion (23) and to have the optimum width a described above if the shaft (20) were virtually rotated coaxially with the fitting hole (41).

Determining the width a and the angle θ1 of inclination of the first notch surface (51*a*) as described above allows the first flat portion (23) and the first notch (51) to be reliably brought into surface contact with each other, and allows the first notch surface (51*a*) to form a sufficiently large pressure receiving surface.

In one or more embodiments, the second end portion (44*b*) of the second flat portion (44) has the second notch (52) with consideration given to the shaft (20) rotating in the reverse direction under the influence of wind or other elements. Specifically, if the first flat portion (23) of the shaft (20) rotating in the reverse direction is slightly inclined with respect to the second flat portion (44) of the fitting hole (41) under the influence of the gap, the other end portion (23*b*) of the first flat portion (23) enters the second space (S2). This can substantially prevent the other end portion (23*b*) of the first flat portion (23) from coming into strong contact with the second end portion (44*b*) of the second flat portion (44), and can reduce the plastic deformation of the inner peripheral surface (42) of the fitting hole (41). In addition, the first flat portion (23) being in surface contact with the second notch surface (52*a*) can reliably reduce the plastic deformation of the second notch surface (52*a*).

Advantages of Embodiments

In the foregoing embodiments, both end portions (44*a*, 44*b*) of the second flat portion (44) of the boss portion (40) each have the notch (51, 52, 53, 54). Thus, if the first flat portion (23) is slightly inclined with respect to the second flat portion (44) during operation of the fan (10), the one end portion (23*a*) of the first flat portion (23) enters the first space (S1). This can substantially prevent the first flat portion (23) from coming into strong local contact with the second flat portion (44). This can reduce the plastic deformation of the inner peripheral surface (42) of the fitting hole (41) resulting from stress concentration.

In the foregoing embodiments, the first notch (51) has the flat first notch surface (51*a*). Thus, as illustrated in FIG. 5, the inclination of the first flat portion (23) allows the first flat portion (23) to be in surface contact with the first notch surface (51*a*). This can reduce the bearing stress acting on the fitting hole (41). As a result, the plastic deformation of the inner peripheral surface (42) of the fitting hole (41) can be more reliably reduced.

Reducing the plastic deformation of the fitting hole (41) in the foregoing manner can reliably prevent the deformed portion and the shaft (20) from meshing with each other. As a result, the impeller (30) can be easily detached from the shaft (20). This simplifies the replacement or maintenance of the impeller (30).

In the foregoing embodiments, the second end portion (44*b*) of the first flat portion (23) has the second notch (52). For this reason, even if the shaft (20) rotates in the reverse direction under the influence of wind or other elements, advantages similar to those of the first notch (51) can reduce the plastic deformation of the inner peripheral surface (42) of the fitting hole (41).

Variations of Embodiments

The foregoing embodiments may be modified as follows.

<First Variation>

Figure 6:
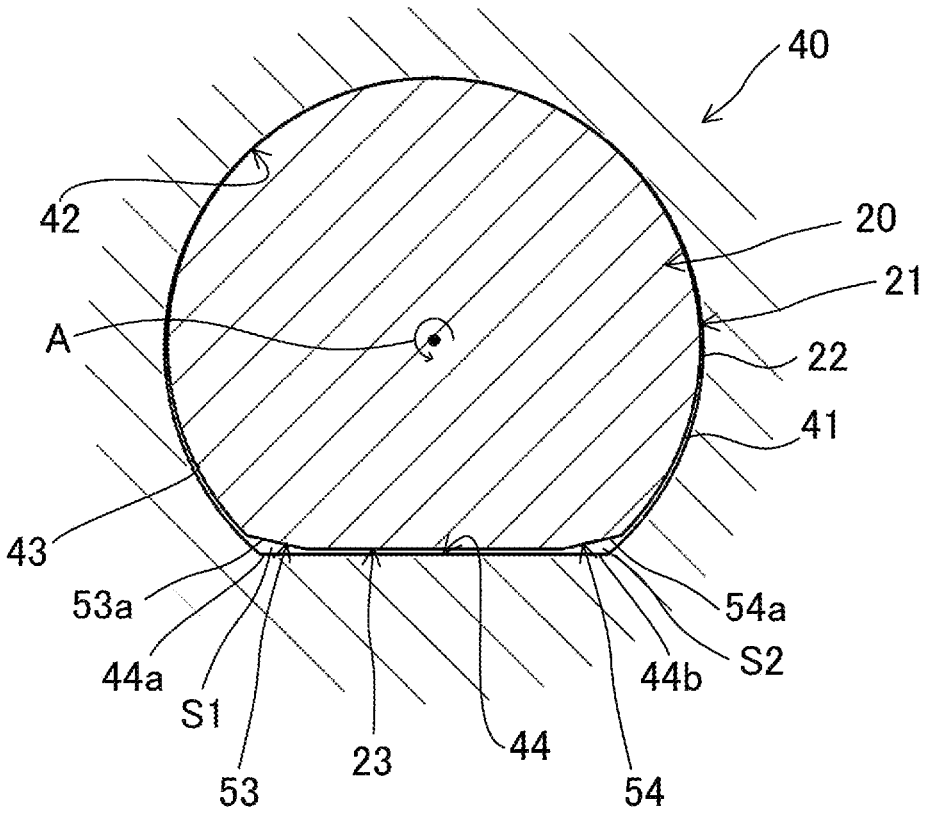
FIG. 6 corresponds to FIG. 3 and illustrates a first variation.

In the first variation illustrated in FIG. 6, end portions of a flat portion (first flat portion (23)) of a shaft (20) in the width direction of the flat portion each have a notch (53, 54). In the first variation, the notches (53, 54) are formed on both end portions, respectively, of the first flat portion (23) in the width direction. Specifically, one of the end portions of the first flat portion (23) in the width direction located backward in the direction of rotation of the shaft (20) (the direction indicated by the arrow A in FIG. 6) has a third notch (53). The other end portion of the first flat portion (23) in the width direction located forward in the direction of rotation of the shaft (20) has a fourth notch (54). In the first variation, a second flat portion (44) has no notch. A first space (S1) is formed between the third notch (53) and the second flat portion (44). A second space (S2) is formed between the fourth notch (54) and the second flat portion (44).

In the first variation, if the forward rotation of the shaft (20) causes the first flat portion (23) to be slightly inclined with respect to the second flat portion (44), a third notch surface (53*a*) and the second flat portion (44) is in surface contact with each other. This can reduce the plastic deformation of the second flat portion (44) just like the foregoing embodiments.

Likewise, if the reverse rotation of the shaft (20) causes the first flat portion (23) to be slightly inclined with respect to the second flat portion (44), a fourth notch surface (54*a*) and the second flat portion (44) is in surface contact with each other. This can reduce the plastic deformation of the second flat portion (44) just like the foregoing embodiments.

Note that the first and second flat portions (23) and (44) may each have notches.

<Second Variation>

Figure 7:
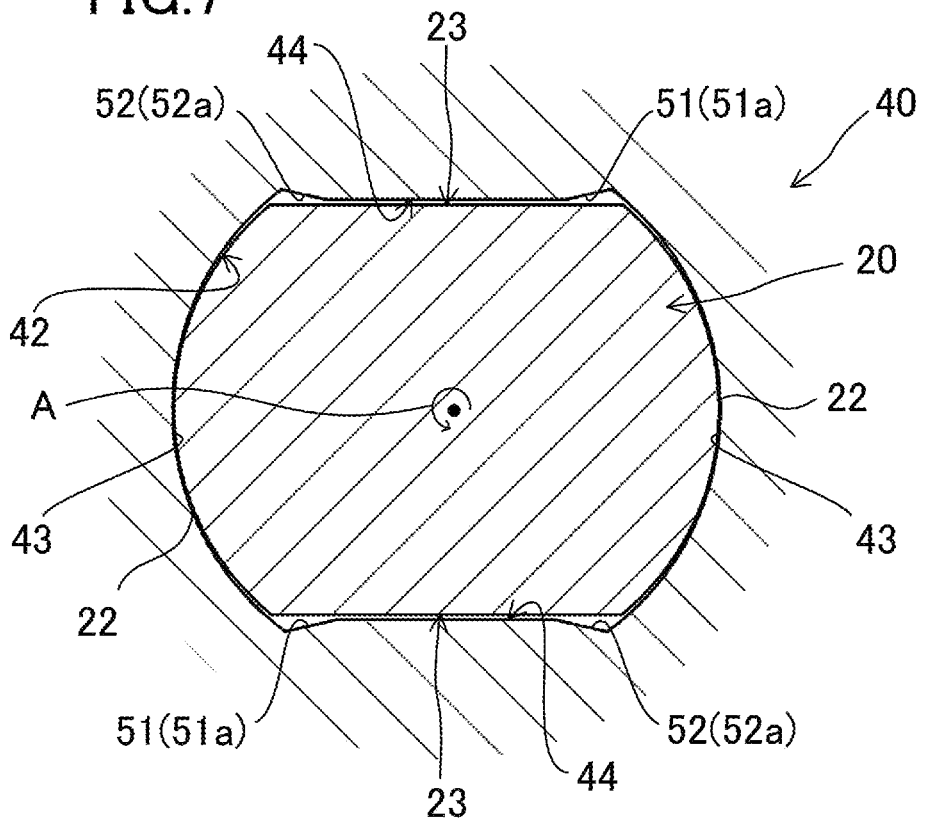
FIG. 7 corresponds to FIG. 3 and illustrates a second variation.

In the second variation illustrated in FIG. 7, an outer peripheral surface (21) of a shaft (20) has two first circular-arc portions (22) and two first flat portions (23). The two first circular-arc portions (22) are located on opposite sides of the axis of the shaft (20). The two first flat portions (23) are located on opposite sides of the axis of the shaft (20).

An inner peripheral surface (42) of a fitting hole (41) of the second variation has two second circular-arc portions (43) and two second flat portions (44). The two second circular-arc portions (43) are located on opposite sides of the axis of the shaft (20). The two second flat portions (44) are located on opposite sides of the axis of the shaft (20). In this variation, the two second flat portions (44) each have notches (51, 52). These notches (51, 52) each have a notch surface (51*a*, 52*a*) that comes into surface contact with the first flat portion (23).

Other Embodiments

In the foregoing embodiments, both end portions of the second flat portion (44) in the width direction thereof each have the notch (51, 52). Alternatively, only one of the end portions of the second flat portion (44) in the width direction thereof may have a notch (51). In this case, it is recommended that only one of the end portions of the second flat portion (44) located backward in the direction of rotation of the shaft (20) have the notch (51). Likewise, only one of both end portions of the first flat portion (23) in the width direction thereof may have a notch (53). In this case, it is recommended that only one of the end portions of the first flat portion (23) located backward in the direction of rotation of the shaft (20) have the notch (53).

The notch surfaces (51*a*, 52*a*, 53*a*, 54*a*) respectively formed by the notches (51, 52, 53, 54) do not always have to be flat, but may be curved or circular arc-shaped, for example.

The fan (10) of the foregoing embodiments may be any other type of fan that includes the shaft (20) and the boss portion (40). For example, the fan (10) may be a centrifugal fan, such as a sirocco fan or a turbofan, another type of axial fan, or a transverse fan, such as a cross-flow fan.

The ordinal numbers such as "first," "second," "third," . . . , described above are used to distinguish the terms to which these expressions are given, and do not limit the number and order of the terms.

As can be seen from the foregoing description, the present disclosure is useful for a fan.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 Fan
20 Shaft
21 Outer Peripheral Surface
22 First Circular-Arc Portion
23 First Flat Portion
40 Boss Portion
41 Fitting Hole
42 Inner Peripheral Surface
42 Second Circular-Arc Portion
44 Second Flat Portion
51 First Notch
51*a* First Notch Surface
52 Second Notch
52*a* Second Notch Surface
53 Third Notch
53*a* Third Notch Surface
54 Fourth Notch
54*a* Fourth Notch Surface

What is claimed is:

1. A fan, comprising:

a shaft comprising an outer peripheral surface that comprises:

a first circular-arc portion; and a first flat portion; and a boss portion comprising a fitting hole with an inner peripheral surface that comprises:

a second circular-arc portion; and a second flat portion, wherein the second circular-arc portion corresponds to the first circular-arc portion, the second flat portion corresponds to the first flat portion, the second flat portion comprises a notch in an end portion in a width direction of the second flat portion, the notch of the second flat portion comprises a notch surface that forms a pressure receiving surface where the notch of the second flat portion is in surface contact with the first flat portion when the shaft rotates, and when viewed in an axial direction of the shaft, a length of a portion where the notch of the second flat portion and the first flat portion contact each other during rotation of the shaft is longer than a distance between the first flat portion and the second flat portion when the shaft stops.

2. The fan according to claim 1, wherein each of end portions of the second flat portion in the width direction comprises the notch.

3. The fan according to claim 2, wherein the outer peripheral surface has a D shape in a cross section taken perpendicular to an extending direction of the shaft.

4. The fan according to claim 1, wherein the outer peripheral surface has a D shape in a cross section taken perpendicular to an extending direction of the shaft.

5. A fan, comprising:

a shaft comprising an outer peripheral surface that comprises:

a first circular-arc portion; and a first flat portion; and a boss portion comprising a fitting hole with an inner peripheral surface that comprises:

a second circular-arc portion; and a second flat portion, wherein the second circular-arc portion corresponds to the first circular-arc portion, the second flat portion corresponds to the first flat portion, one or both of the first flat portion and the second flat portion comprises a notch in an end portion in a width direction of the one or both of the first flat portion and the second flat portion, the notch comprises a flat notch surface that forms a pressure receiving surface where the shaft and the boss portion are in contact when the shaft rotates, and the pressure receiving surface and the first or second flat portion facing the pressure receiving surface come into contact with each other and form a flat contact area.

6. A fan, comprising:

a shaft comprising an outer peripheral surface that comprises:

a first circular-arc portion; and a first flat portion; and a boss portion comprising a fitting hole with an inner peripheral surface that comprises:

a second circular-arc portion; and a second flat portion, wherein the second circular-arc portion corresponds to the first circular-arc portion, the second flat portion corresponds to the first flat portion, and the first flat portion comprises a notch in an end portion at an end in a width direction of the first flat portion.

* * * * *